US009512807B2

(12) United States Patent
Grande Fernández et al.

(10) Patent No.: US 9,512,807 B2
(45) Date of Patent: Dec. 6, 2016

(54) HEAT EXCHANGER FOR COOLING EXHAUST GAS

(75) Inventors: José Antonio Grande Fernández, Vigo-Pontevedra (ES); Ángel Chamadoira Gómez, Vigo-Pontevedra (ES)

(73) Assignee: BORGWARNER EMISSIONS SYSTEMS SPAIN, S.L. UNIPERSONAL, Vigo-Pontevedra (ES)

( * ) Notice: Subject to any disclaimer, the term of this patent is extended or adjusted under 35 U.S.C. 154(b) by 172 days.

(21) Appl. No.: 14/112,843

(22) PCT Filed: May 10, 2012

(86) PCT No.: PCT/EP2012/058592

§ 371 (c)(1),
(2), (4) Date: Oct. 18, 2013

(87) PCT Pub. No.: WO2012/132852

PCT Pub. Date: Nov. 15, 2012

(65) Prior Publication Data

US 2014/0041644 A1 Feb. 13, 2014

(30) Foreign Application Priority Data

May 11, 2011 (EP) ..... 11382141

(51) Int. Cl.
*F02B 47/08* (2006.01)
*F28D 7/10* (2006.01)
(Continued)

(52) U.S. Cl.
CPC ..... *F02M 25/0715* (2013.01); *F02M 26/13* (2016.02); *F02M 26/32* (2016.02); *Y10T 29/49229* (2015.01)

(58) Field of Classification Search
CPC F28F 9/0241; F28F 9/0236; F02M 25/0707; F02M 25/0737; F02B 29/0475; F02B 29/0493; F28D 9/0043; F28D 21/0003
USPC ..... 123/568.12, 563; 165/157, 81
See application file for complete search history.

(56) References Cited

U.S. PATENT DOCUMENTS 7,857,039 B2 * 12/2010 Nakamura ..... F28D 9/0025 165/157
2004/0226694 A1 11/2004 Dilley et al.
(Continued)

FOREIGN PATENT DOCUMENTS

JP S62-029588 2/1987
JP H05-096765 12/1993
WO WO 2010/098321 A1 9/2010

OTHER PUBLICATIONS

Extended European Search Report dated Sep. 14, 2011 in corresponding European Patent Application No. 11382141.7.
(Continued)

*Primary Examiner* — Hung Q Nguyen
*Assistant Examiner* — Syed O Hasan
(74) *Attorney, Agent, or Firm* — Jenkins, Wilson, Taylor & Hunt, P.A.

(57) ABSTRACT

The present invention relates to a heat exchanger for cooling a gas which can mainly be applied in EGR systems with a floating core. The differences in temperature achieved during operation of the casing and the core of gas ducts housed therein give rise to degrees of expansion which are also different. If the ends of both components were fixed to each other, stresses which would cause the breakage thereof would occur. The common solution applied is to leave one of the ends of the core of ducts floating, i.e., with capacity for longitudinal displacement with respect to the casing to prevent the occurrence of stresses. The floating end of the core has an attachment by means of O-ring gaskets. The O-ring gaskets are made of an elastomer that cannot reach very high temperatures, hence in the state of the art the floating attachment is on the side where the already cooled gas exits. The invention is characterized by a special manner of attaching the end where the core is floating and the casing so as to allow the end where the hot gas enters to be the end where the attachment is a floating attachment.

9 Claims, 3 Drawing Sheets

(51) Int. Cl.
*F28F 7/00* (2006.01)
*F02M 25/07* (2006.01)

(56) References Cited

U.S. PATENT DOCUMENTS

2005/0199227 A1* 9/2005 Juschka ..... F01N 3/0205 123/568.12
2007/0181294 A1* 8/2007 Soldner ..... F28D 9/0031 165/175
2011/0162826 A1* 7/2011 Garret ..... F28F 9/0219 165/157
2011/0308778 A1 12/2011 Tsuda et al.

OTHER PUBLICATIONS

International Search Report dated Jun. 22, 2012 in corresponding International Application No. PCT/EP2012/058592.
English translation of Japanese Office Action corresponding to Japanese Patent Application No. 2014-509730 dated Sep. 4, 2015.

* cited by examiner

HEAT EXCHANGER FOR COOLING EXHAUST GAS

CROSS-REFERENCE TO RELATED APPLICATIONS

This application is filed under the provisions of 35 U.S.C. §371 and claims the priority of International Patent Application No. PCT/EP2012/058592 filed on May 10, 2012, and of European Patent Application No. 11382141.7 filed on May 11, 2011. The disclosures of the foregoing international patent application and European patent application are hereby incorporated by reference herein in their respective entireties.

OBJECT OF THE INVENTION

The present invention relates to a heat exchanger for cooling a gas which can mainly be applied in EGR (Exhaust Gas Recirculation) systems where the combustion gases of a combustion engine are cooled before being reintroduced into the inlet.

In exchangers of this type, the use of a casing housing a core of ducts through which the gas to be cooled flows is common. Between the casing and the core of ducts there is a space through which the cooling fluid flows. The casing is in direct contact with the cooling fluid and the core of ducts is in contact with the hot gas to be cooled. The differences in temperature achieved by both components during operation give rise to degrees of expansion which are also different. If the ends of either component were fixed to each other, stresses which would cause the breakage thereof would occur. A solution that is applied is to leave one of the ends of the core of ducts floating, i.e., with capacity for longitudinal displacement with respect to the casing to prevent the occurrence of stresses.

The floating end of the core has an attachment by means of O-ring gaskets. The O-ring gaskets are made of an elastomer that cannot reach very high temperatures, hence in the state of the art the floating attachment is on the side where the already cooled gas exits.

The invention is characterized by a special manner of attaching the end where the core is a floating core and the casing so as to allow the end where the hot gas enters to be the end where the attachment is a floating attachment.

BACKGROUND OF THE INVENTION

In designing components for vehicle combustion engines, the little space available is a strong limitation which very often requires redesigning the configuration and arrangement of some of its components.

The increase in the number and type of components that are gradually incorporated in the engines and must be placed in the same space make this limitation worse. This is the case of EGR systems which recirculate part of the exhaust gases towards the inlet for injecting gas without oxygen into the combustion chamber and thus reduce the percentage of nitrogen oxides generated.

The gas that exits after combustion is at a high temperature such that, before reintroducing part of this gas into the inlet, it is necessary to reduce its temperature. The temperature of this gas is reduced by using a heat exchanger. The heat exchanger directs two flows, a flow of the gas to be cooled and a flow of a cooling fluid which removes heat from the gas to reduce its temperature.

The gas flow circulates through a core of ducts surrounded by the cooling fluid. The cooling fluid flows between the core of tubes and the outer casing of the exchanger. Both flows have their inlets or outlets duly connected, communicating the exchanger with the ducts of the engine distributing both flows by means of suitable connections.

The core of ducts through which the gas circulates undergoes great temperature changes as it goes from being at rest to operating, cooling the hot gas. These temperature changes cause the expansion or shrinkage of the core of ducts. This expansion occurs in the casing to a lesser degree since this is mainly in contact with the cooling fluid. The hot gas mass flow to be cooled is high, hence the dimensions and particularly the length of the core of ducts are significant and its expansion may cause great increases in length. The difference in temperatures in the casing and in the core of ducts gives rise to different degrees of expansion. If the ends of both components were fixed, it would give rise to very high stresses and to the breakage of the part.

A solution which is commonly applied is fixing one of the ends of the core and the casing, whereas the other end of both components is fixed by means of a floating attachment allowing the relative longitudinal displacement of one with respect to the other. The fixed attachment is normally done through a flange. The weight of the core, the casing and the cooling fluid housed between the casing and the core is very high, hence the flange is a rather bulky component in order to be able to offer sufficient structural strength.

The other end of the exchanger has a floating attachment between the core and the casing, the core of ducts converging into a manifold which is extended according to a bushing with a determined diameter which is fitted inside another larger bushing arranged in the casing. O-ring gaskets preventing the cooling fluid from exiting are placed between both bushings. The O-ring gaskets limit the movements in transverse directions up to a certain point. The longitudinal direction is not impeded and the axial or longitudinal displacement between both bushings is possible as the result of the sliding of the O-ring gaskets.

The inner bushing whereby the manifold of the core is prolonged is in direct contact with the gas. The O-ring gaskets are made of an elastomer which does not withstand temperatures as high as metal does. O-ring gaskets typically degrade above 180° C. This limitation implies that in the state of the art the floating end of the heat exchanger corresponds with the exit of the cooled gas where the temperature of the gas is lower.

Certain arrangements of components in the cavity where the engine is located prevent housing the volume required for the fixed fixing of the exchanger, which fixing is not floating, and this cannot be exchanged with the floating area since exchanging the cold inlet with the hot inlet at the floating end (where the volume is less) would give rise to the degradation of the O-ring gaskets due to excessive temperature.

The present invention solves this technical problem by modifying the configuration in the hot gas inlet allowing the entrance of hot gas at the end where the core of ducts of the exchanger is a floating core.

DESCRIPTION OF THE INVENTION

A first aspect of the invention is a heat exchanger which allows solving the aforementioned problem such that the fixed attachment is at the end where the cooled gas exits and the floating attachment is at the end where the hot gas to be cooled enters. This second floating end occupies less volume and allows, in certain situations, being able to install the exchanger in limited spaces which would otherwise not be possible to be introduced.

The exchanger of the invention comprises:

a casing housing therein a core of one or more ducts for the passage of the gas to be cooled, wherein between the core and the casing there is a space with access openings for the entrance and exit of a cooling fluid flow, and wherein the core has an end for the entrance of the hot gas and the other end for the exit of the cooled gas, one of the ends being fixed with respect to the casing and the other end floating, also with respect to the casing, for expansion compensations, As in the state of the art, the exchanger of the invention combines the use of a casing and a core of ducts placed therein. The core of ducts is what allows the passage of the gas to be cooled. The cooling fluid is in contact with the ducts through which the gas passes and removes the heat to reduce its temperature. The liquid is between the core and the casing. The gas flow and the cooling fluid flow have their own independent guiding means.

The casing is in contact with the cooling fluid and has a lower temperature than the core of ducts since these are in contact with the hot gas in their inner part. This difference in temperatures in operative mode causes the different expansions between both components. In order to avoid stresses which cause breakage, the casing and the core are attached according to fixed attachment at one of the ends of the exchanger and at the other end they are attached according to a floating attachment to allow the longitudinal displacement of one with respect to the other.

the floating end of the core is the end intended for the entrance of the hot gas and the fixed end is the end intended for the exit of the cooled gas, Unlike the state of the art, the end through which the hot gas is introduced is the floating end. As will be seen in the following technical rules, this is possible because the floating attachment is protected in a particular manner.

the floating end of the core has a manifold for distributing the incoming gas into one or more ducts of the core and is prolonged according to a bushing at its inlet, The inlet for the incoming hot gas must be distributed through one or more ducts of the core of ducts. It is preferable for it to be distributed through all the ducts, making use of the largest possible exchange area to remove the heat. The distribution from the inlet into the duct or ducts is carried out by means of a manifold, where in a preferred embodiment of the invention it will be seen to have a diverging shape. This manifold is extended at its end by means of a sector known as a bushing which is the manner of identifying the sector where the gaskets which allow the attachment to be a floating attachment will be supported.

the floating attachment between the floating end of the core and the casing is by means of interposing one or more gaskets between the bushing of the manifold and the casing, Between the bushing of the manifold and the casing there is a space which allows there to be transverse displacement (the preferred direction of the ducts of the core is taken as the longitudinal reference) and also longitudinal displacement between both components. Although the other end of the exchanger links in a fixed manner the casing with respect to the core of ducts, transverse displacement is possible through the bending of the core, for example, due to vibrations or differences in temperature between the tubes. The longitudinal displacement is possible, for example, through expansion.

The gasket or gaskets are interposed in this space. These gaskets prevent the relative transverse displacement between the casing and the bushing of the manifold of the core but it does not prevent the longitudinal displacement, hence this attachment is said to be a floating attachment.

The gaskets not only prevent the transverse displacement but they prevent the cooling fluid between the core and the casing from leaking.

the exchanger additionally has a guiding hood for guiding the hot gas from the inlet towards the inner cavity of the manifold such that between the hood and the bushing of the manifold there is a stagnation space for protecting the gaskets from the heat.

If this hood was not here, the incoming gas would be in direct contact with the bushing, transmitting its temperature to the bushing and the latter in turn to the gaskets. The inlet temperature of the gas will give rise to temperatures in the gaskets which would eventually degrade the gaskets and render the device inoperative.

The presence of the hood allows guiding the gas towards the inner cavity of the manifold avoiding direct contact with the bushing. Not only is direct contact avoided but a space between the hood and the bushing where the speed of the flow is almost nil, and is therefore considered as stagnant, is generated. The heat transfer between the hood and the bushing is indirect by interposing the stagnation gas and therefore the temperature of the bushing is lower until it reaches values at which the gasket does not deteriorate.

Dependent claims 2 to 7 as well the combinations resulting from the dependency establish particular embodiments which are considered incorporated by reference to this description.

A second aspect of the invention is a method of attachment between the casing and the core in a heat exchanger according to claim 8 which, together with dependent claim 9, are incorporated by reference to this description. According to this method of attachment, the temperature of the area where the gaskets are located is reduced since the incoming hot gas flow is guided exceeding the position of the bushing by means of a hood leaving a stagnation area in the flow which is placed between the hood and the bushing.

DESCRIPTION OF THE DRAWINGS

The foregoing and other features and advantages will be better understood from the following detailed description of a preferred embodiment in reference to the attached drawings, given only by way of an illustrative and non-limiting example.

DETAILED DESCRIPTION OF THE INVENTION

The present invention relates to a heat exchanger for application in EGR systems where part of the combustion gases are led to the combustion chamber again to reduce the oxygen content and to thus reduce $NO_x$ emission. These gases must first be cooled. A heat exchanger such as the heat exchanger of this invention allows carrying out this function.

The description of the state of the art and of the invention have already discussed the space problem which involves, in determined cases, the fixed support between the casing and core having a greater volume than the support located at the end where the attachment between the same elements is a floating attachment, and this support having a greater volume being at the hot gas inlet.

The exchanger of the invention allows the floating attachment between the casing and the core to be located at the hot gas inlet.

Figure 1:
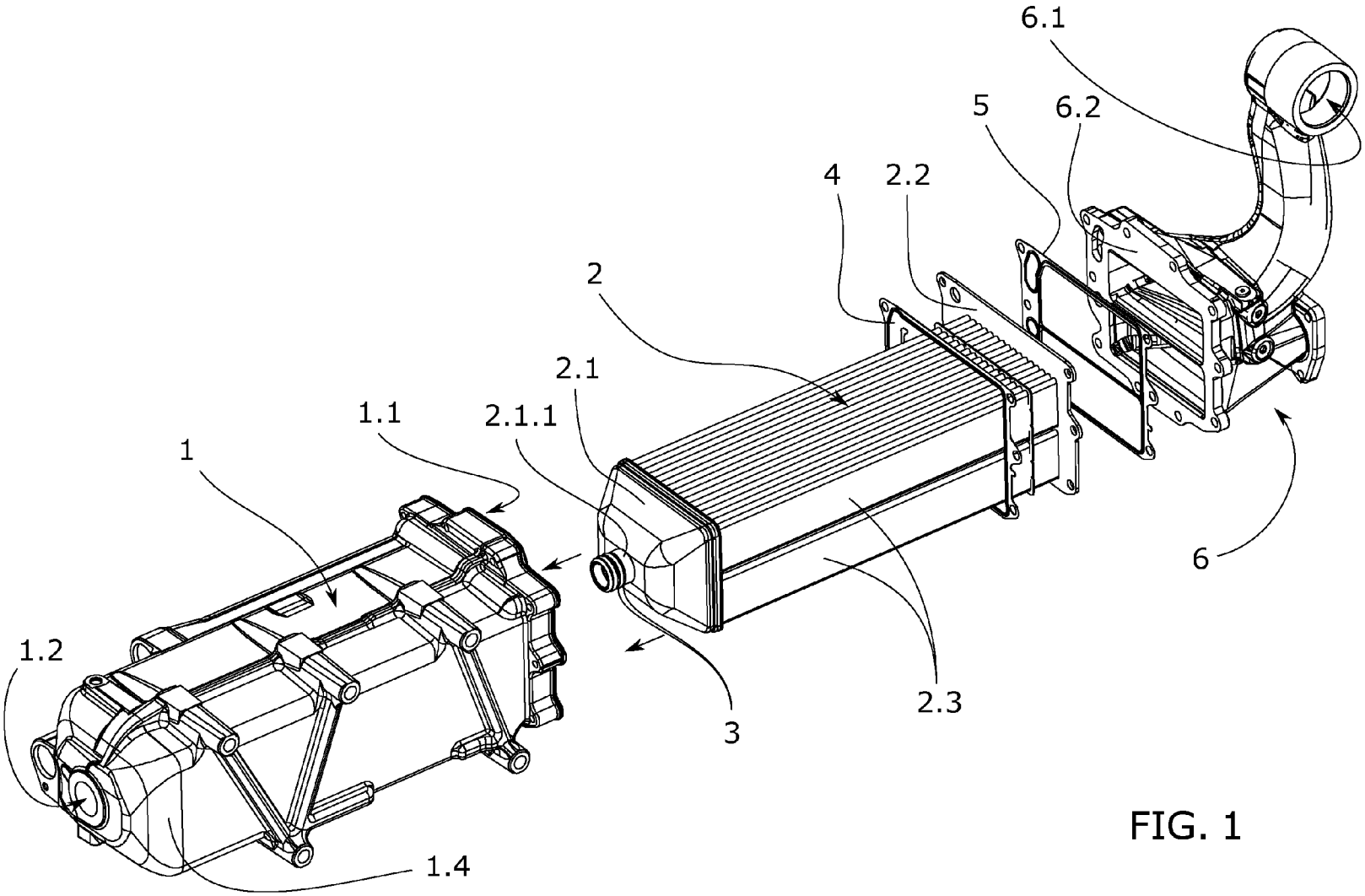
FIG. 1 shows an exploded perspective view of a heat exchanger according to a first embodiment of the invention. The casing, core of ducts for cooling the gas and the manifolds and supports of the device are seen in this figure.

FIG. 1 shows a first embodiment of the invention with most of the components shown in an exploded perspective view. For the sake of clarity, screws, ducts coupled to the device and other accessories have been removed.

FIG. 1 shows the body forming the casing (1) which houses therein the core (2) formed from a packing of ducts which in this case are hollow section sectors (2.3).

At one end of the casing (1), the left end according to the orientation used in the figure, there is a hot gas inlet (1.2). This hot gas inlet (1.2) is located in a cover (1.4) closing the space of the inner cavity of the casing (1) at this end.

An opening with a seat (1.1) intended for receiving the core (2) is at the opposite end of the casing (1).

The next component shown in this FIG. 1 is the core (2). The direction and orientation for insertion of the core (2) in the casing (1) are shown with two short arrows.

The main body of the core (2) is formed by the packing of ducts having a preferred longitudinal direction. At the end of the core (2) which is on the left of the figure, the ducts converge into a manifold (2.1) which in turn extends in a bushing (2.1.1). Once the core (2) is introduced into the casing (1), this bushing (2.1.1) reaches the hot gas inlet (1.2) of the entrance of the casing (1) in conditions which will be described below.

In this embodiment, the bushing (2.1.1) is a cylindrical element through which the hot gas enters. O-ring gaskets (3) which will be the those establishing the sealing between the core (2) and the casing (1) to prevent the exit of the cooling fluid are shown on its outer surface.

Once the hot gas enters through the bushing (2.1.1), the manifold (2.1) distributes it through the set of ducts forming the packing to increase the heat exchange surface for the exchange of heat between the gas and the cooling fluid surrounding the packing.

After the gas is cooled, it reaches the opposite end where it exits. This opposite end is shown on the right in the figure, and it also shows a flange (2.2) which is supported in the seat (1.1) of the casing (1) after being inserted. On both sides of the flange (2.2) the exploded graphic depiction shows the gaskets (4, 5) which assure the proper sealing of the flange (2.2) both with the seat (1.1) of the casing (1) on one side and on the other with the seat (6.2) of the last part shown, the gas outlet manifold (6).

The gas outlet manifold (6) receives the cooled gas after it has passed through the ducts of the packing of the core (2). In this particular case, the figure shows an outlet (6.1) but it has another outlet for a particular application requiring a second flow.

Figure 2:
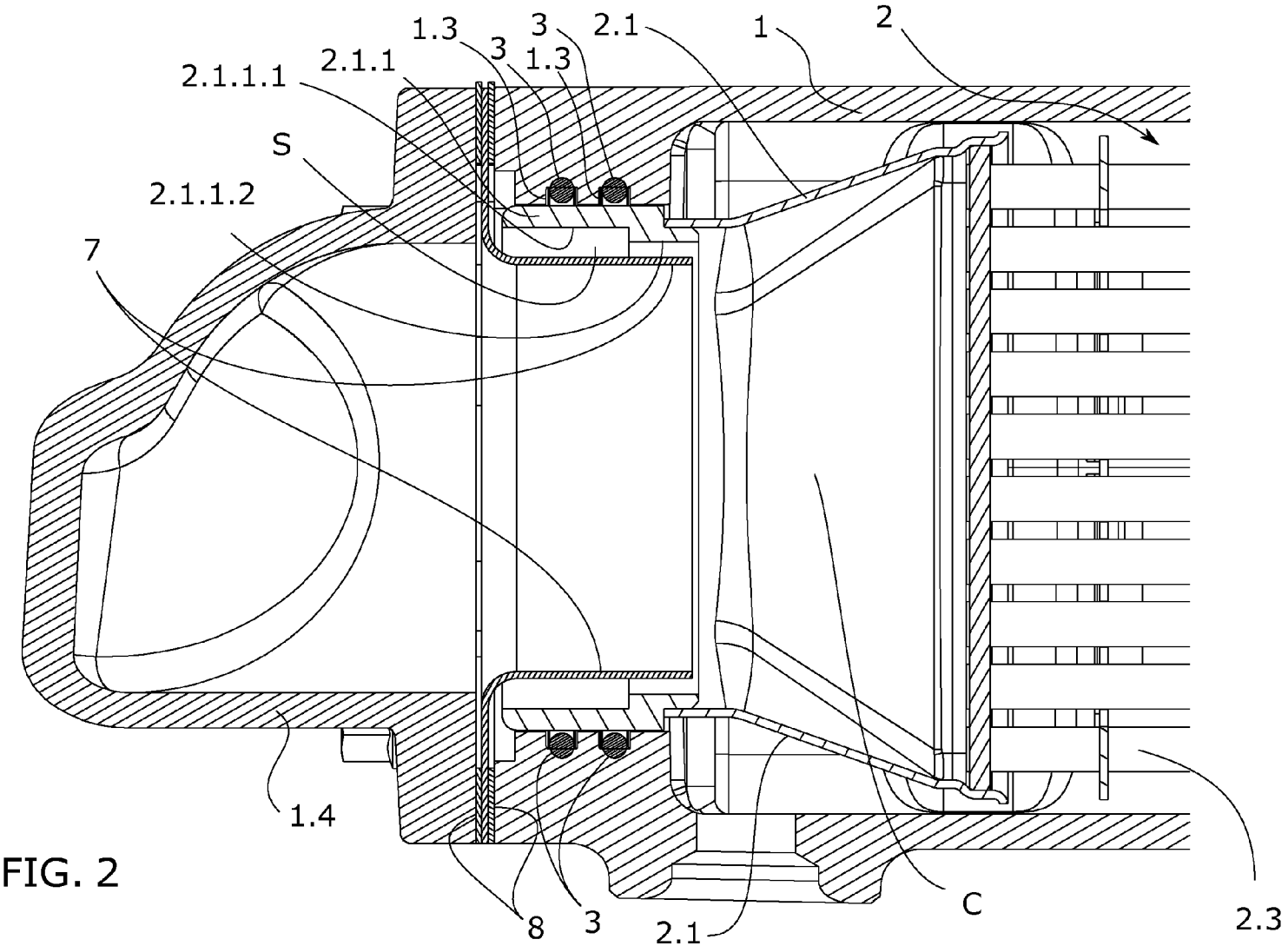
FIG. 2 shows a partial cross-section of the embodiment of FIG. 1 of the area of attachment between the core of gas ducts and the casing at the end where the attachment is a floating attachment.

FIG. 2 shows a cross-section of this same embodiment in the area where the floating attachment between the casing (1) and the core (2) is arranged.

Likewise following the orientation shown in the figure, the cover (1.4) where the hot gas inlet (1.2) (not shown in this section) is located is depicted in cross-section on the left. This hot gas enters up to the cavity (C) inside the manifold (2.1) guided by a hood (7). The manifold (2.1) has a diverging shape which allows distributing the hot gas to each of the section sectors (2.3) giving rise to the ducts where the gas will be cooled.

The hood (7) is a part which starts from a planar configuration which is fitted in the seat between the cover (1.4) and the main body of the casing (1). The gaskets (8) sealing this seat are distinguished on both sides of the seat of the hood (7). The hood (7) is prolonged from this plane towards the right converging towards a cylindrical tubular configuration prolonging the guiding from the cover (1.4) towards the cavity (C) of the manifold (2.1).

As has been described with the aid of FIG. 1, the manifold (2.1) is prolonged by means of a bushing (2.1.1) which in this embodiment is an independent part. The cylindrical tubular body of the hood (7) is located coaxial to and inside the cylindrical body formed by the bushing (2.1.1), leaving a space (S) between both. This space (S) is in communication with the cavity (C), nevertheless, since it is a cavity closed on one of the sides, there is no flow and the conditions therein, in operative mode, are stagnant.

The existence of a volume of gas in stagnant conditions between the tubular sector of the hood (7) and the bushing (2.1.1) gives rise to the fact that the heat transfer between both bodies is only by natural convection and radiation instead of by forced convection (much more efficient transferring heat), protecting the second bushing (2.1.1) from the high temperature of the gas. Natural convection is understood as the transport phenomenon by convection mainly caused by the actuation of the gravitational field on a fluid having variations in its density causing buoyancy phenomena in its fluid particles. This is an effect caused by volumetric forces. Forced convection is understood as that in which the transport phenomena have a different cause from the aforementioned and there is an action which causes its movement: pressure gradients, the action of a mobile surface, or the interaction with a flow forced by any driving means. To check the difference in orders of magnitude between the heat transfer coefficients in either case, typical values with natural convection are about 9 $W/m^{2\circ}$ C. and typical values with forced convection can be about 300 $W/m^{2\circ}$ C. in the case of EGR coolers.

Since the bushing (2.1.1) is in direct contact with the gaskets (3), in this embodiment the gaskets are O-ring gaskets, for the attachment and fitting between the bushing (2.1.1) and the casing (1), so the gaskets (3) are no longer exposed to such high temperatures and are capable of withstanding the temperatures to which they are subjected to without degrading.

In this embodiment, the bushing (2.1.1) shows an inner step closing the space between the bushing (2.1.1) and the end of the tubular sector of the hood (7), reducing the possibility of flow induction by the disturbances generated by the passage of the gas from the hood (7) to the inner cavity (C) of the manifold (2.1). Thus, this step gives rise to a first inner sector of the bushing (2.1.1.1) generating the stagnation space (S) and a second inner sector of the bushing (2.1.1.2) which partially closes the stagnation space (S) at the end of the tubular body of the hood (7).

The figure shows how the casing (1) internally has grooves (1.3) in which there are housed O-ring gaskets (3) which are in turn responsible for being supported against the outer surface of the bushing (2.1.1). The depiction of the gaskets (3) in cross-section is shown invading part of the material because it is the manner of depicting a flexible element which is forced to be deformed in order to be located in its intended space once built in a prototype.

Figure 3:
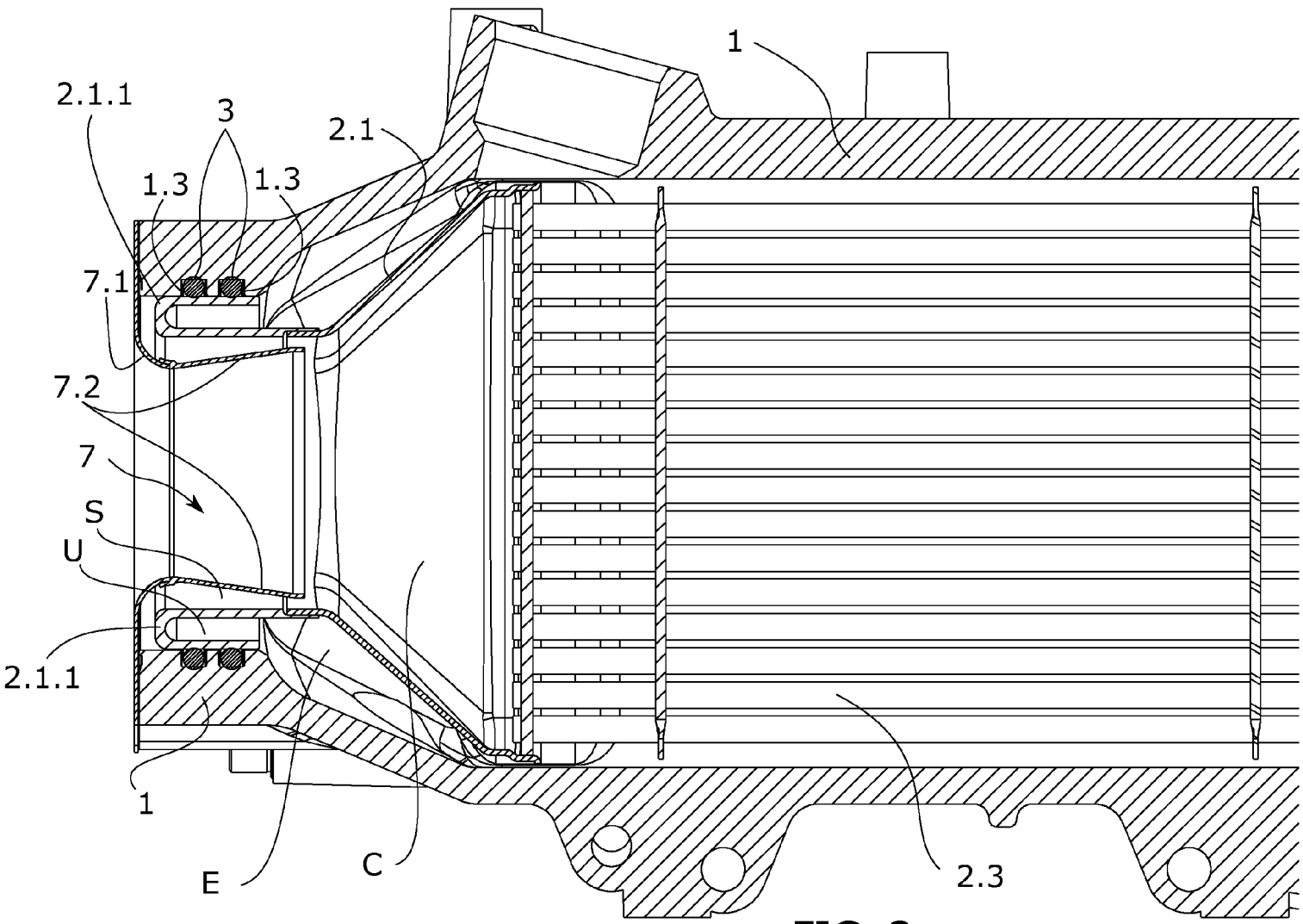
FIG. 3 shows a partial cross-section of a second embodiment of the area of attachment between the core of gas ducts and the casing at the end where the attachment is a floating attachment.

FIG. 3 shows a cross-section of the same region according to FIG. 2 but of a second embodiment of the invention.

In this second embodiment of the invention a greater level of cooling of the region where the O-ring gaskets (3) are located is achieved. Since the bushing (2.1.1) is the part which allows sealing the passage of the coolant, this sealing precisely prevents the cooling fluid from removing the heat from the bushing (2.1.1). Therefore, the second embodiment solves the problem of how the cooling fluid cools the bushing (2.1.1) in order to thereby also to reduce the temperature in the O-ring gaskets (3).

The technical solution consists of modifying the configuration of the bushing (2.1.1) such that its section is shown in U shape with the opening of the U shape in communication with the outer cavity (E) where the cooling fluid is, i.e., the space between the core (2) and the casing (1).

Now the section of the bushing (2.1.1) has two tubular sectors, both branches of the U, an outer tubular sector and an inner tubular sector. The outer tubular sector is what supports the O-ring gaskets (3) and the inner tubular sector is that which is in contact with the stagnation space (S). So between both tubular sectors there is an extra space (U) where the cooling fluid is interposed. Therefore, according to this second embodiment, there are two thermal barriers between the hot gas and the O-ring gaskets (3): the stagnation space (S) and the extra space (U). The first one has stagnant gas and the second one has cooling fluid. For the first one, it is advisable for the stagnation space (S) has minimal contact with the gas flow and thereby the stagnant situation is stable, preventing the entrance of gas at a high temperature, whereas for the second one, it is advisable for the communication of the extra space (U) with the rest of the volume where the cooling fluid flows be as large as possible because it will favor heat removal. It is observed that these two objectives have been achieved in the configuration shown in FIG. 3.

Particularly in this second example, the tubular sector of the hood (7) breaks down into a first converging sector (7.1) and a second diverging sector (7.2). The diverging sector favors a smoother transition with the already diverging sector of the manifold (2.1), reducing the occurrence of turbulence due to an expansion which gives rise to a negative pressure gradient. For a simpler manufacture by stamping, both sectors are manufactured in different parts which have been subsequently attached to one another.

In this case, the second diverging sector also achieves narrowing the passage of the stagnation space (S) at its end to the inner cavity of the manifold (2.1), partially closing it.

The invention claimed is:

1. A heat exchanger for cooling a gas, the heat exchanger comprising:

a casing containing therein a battery of one or more ducts arranged for passage of the gas to be cooled, wherein access openings for entrance and exit of a cooling fluid flow are provided between the battery and the casing, and wherein:

the battery comprises a first end for entrance of hot gas and a second end for exit of cooled gas, with the second end being a fixed end that is fixed with respect to the casing and the first end being a floating end that is floating with respect to the casing to accommodate expansion;

the floating end comprises a manifold for distributing hot gas into one or more ducts of the battery and is lengthened with a bushing arranged at an inlet of the manifold;

an attachment between the floating end and the casing includes at least one gasket interposed between the bushing and the casing; and the heat exchanger further comprises a guiding hood for guiding hot gas from the inlet toward an inner cavity of the manifold such that between the guiding hood and the bushing of the manifold there is a gas stagnation space that protects the at least one gasket from heat.

2. The heat exchanger according to claim 1, wherein an inner face of the bushing comprises a section defining a separating space of reduced size between the guiding hood and the bushing that partially closes communication of the space with the inner cavity to form the gas stagnation space that protects the at least one gasket from heat.

3. The heat exchanger according to claim 1, wherein an end of the bushing includes a U-shaped section with an opening of the U-shaped section being in communication with an outer cavity of the heat exchanger arranged to receive a flow of cooling fluid.

4. The heat exchanger according to claim 1, wherein the guiding hood comprises a first converging sector and a second diverging sector.

5. The heat exchanger according to claim 1, wherein the at least one gasket comprises at least one O-ring gasket.

6. The heat exchanger according to claim 1, wherein fixed attachment between the battery and the casing is provided with a flange.

7. The heat exchanger according to claim 1, wherein the bushing is distinct from the manifold.

8. A method of attaching a casing and a battery of one or more ducts for the passage of the gas to be cooled in a heat exchanger, the method comprising:

providing access openings between the battery and the casing to permit entrance and exit of a flow of cooling fluid;

providing a first end of the battery for entrance of hot gas and a second end for exit of cooled gas, with the second end being a fixed end arranged to be fixed with respect to the casing, and with the first end being a floating end arranged to be floating with respect to the casing to accommodate expansion, wherein the floating end comprises a bushing;

attaching the floating end and the casing with an interposing at least one gasket; and providing a guiding hood for guiding an incoming flow of hot gas, leaving a gas stagnation space between the guiding hood and the bushing to reduce heat transfer to the at least one gasket.

9. A method according to claim 8, wherein the bushing comprises a U-shaped section with an opening of the U-shaped section oriented toward a space in which cooling fluid is located, with a first sector of the U-shaped section being in direct contact with the gas to be cooled and with a second sector of the U-shaped section supporting the at least one gasket, and the method further comprises removing heat from the bushing by flowing cooling fluid between the first sector and the second sector.

* * * * *